US008305372B2

(12) United States Patent
Ting et al.

(10) Patent No.: US 8,305,372 B2
(45) Date of Patent: Nov. 6, 2012

(54) DISPLAY AND METHOD FOR ELIMINATING RESIDUAL IMAGE THEREOF

(75) Inventors: Yu-Hsin Ting, Kaohsiung County (TW); Tsao-Wen Lu, Taipei County (TW)

(73) Assignee: Au Optronics Corporation, Hsinchu (TW)

( * ) Notice: Subject to any disclaimer, the term of this patent is extended or adjusted under 35 U.S.C. 154(b) by 649 days.

(21) Appl. No.: 12/490,302

(22) Filed: Jun. 23, 2009

(65) Prior Publication Data

US 2010/0277462 A1 Nov. 4, 2010

(30) Foreign Application Priority Data

Apr. 29, 2009 (TW) ..... 98114223 A

(51) Int. Cl.
*G09G 5/00* (2006.01)

(52) U.S. Cl. ..... 345/211; 345/95

(58) Field of Classification Search ..... 345/87, 345/92, 98, 100, 102, 211, 212
See application file for complete search history.

(56) References Cited

U.S. PATENT DOCUMENTS

| | | | | |
|---|---|---|---|---|
| 5,945,970 | A * | 8/1999 | Moon et al. | 345/92 |
| 7,944,440 | B2 * | 5/2011 | Park | 345/211 |
| 2002/0080133 | A1 * | 6/2002 | Eu | 345/212 |
| 2004/0160408 | A1 * | 8/2004 | Hwang | 345/102 |
| 2008/0165109 | A1 * | 7/2008 | Joo et al. | 345/98 |

FOREIGN PATENT DOCUMENTS

| | | | |
|---|---|---|---|
| CN | 1845233 | | 10/2006 |
| CN | 101271671 | | 9/2008 |
| JP | 2008-304566 | A * | 12/2008 |
| TW | 200816150 | | 4/2008 |

OTHER PUBLICATIONS

"Second Office Action of China Counterpart Application", issued on Mar. 9, 2011, p. 1-p. 5.

* cited by examiner

*Primary Examiner* — Chanh Nguyen
*Assistant Examiner* — James Nokham
(74) *Attorney, Agent, or Firm* — Jianq Chyun IP Office

(57) ABSTRACT

A display and a method for eliminating a residual image thereof are provided. The method includes detecting a status of an electric power supplied by a power supply unit of the display when the display is in the power on state; and coupling the electric power to a reference voltage when the electric power is suddenly terminated so as to accelerately discharge charges remaining on the electric power.

14 Claims, 4 Drawing Sheets

DISPLAY AND METHOD FOR ELIMINATING RESIDUAL IMAGE THEREOF

CROSS-REFERENCE TO RELATED APPLICATION

This application claims the priority benefit of Taiwan application serial no. 98114223, filed Apr. 29, 2009. The entirety of the above-mentioned patent application is hereby incorporated by reference herein and made a part of specification.

BACKGROUND OF THE INVENTION

1. Field of the Invention

The present invention generally relates to a flat panel display; more specifically, to a liquid crystal display.

2. Description of Related Art

In recent years, with great advance in the fabricating techniques of opto-electronics and semiconductor devices, flat panel displays (FPDs) have been vigorously developed. Among the FPDs, a liquid crystal display (hereinafter "LCD") has become the mainstream display product due to its advantages of outstanding space utilization efficiency, low power consumption, free radiation, and low electrical field interference. However, since the charges remaining on the electric power supplied by the power supply unit of the LCD can not be discharged timely when the conventional LCD's power is suddenly terminated, so that each of the pixels within the display panel would remain the charges therein, and thus causing the residual image remaining on the display panel for a shorten duration.

SUMMARY OF THE INVENTION

Accordingly, the present invention provides a display including a power supply unit, a display panel, and a discharge unit. The power supply unit supplies an electric power to the display when the display is in the power on state. The display panel includes a plurality of pixels arranged in an array for displaying an image. The discharge unit is coupled to the power supply unit and used for coupling the electric power to a reference voltage when the electric power is suddenly terminated so as to accelerately discharge charges remaining on the electric power and thereby eliminating charges remaining on the pixels.

The present invention also provides a method for eliminating a residual image on a display. The method includes detecting a status of an electric power supplied by a power supply unit of the display when the display is in power on state; and coupling the electric power to a reference voltage when the electric power is suddenly terminated so as to accelerately discharge charges remaining on the electric power.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Reference will now be made in detail to the present embodiments of the invention, examples of which are illustrated in the accompanying figures. In addition, whenever possible, identical or similar reference numbers stand for identical or similar elements in the figures and the embodiments.

Figure 1:
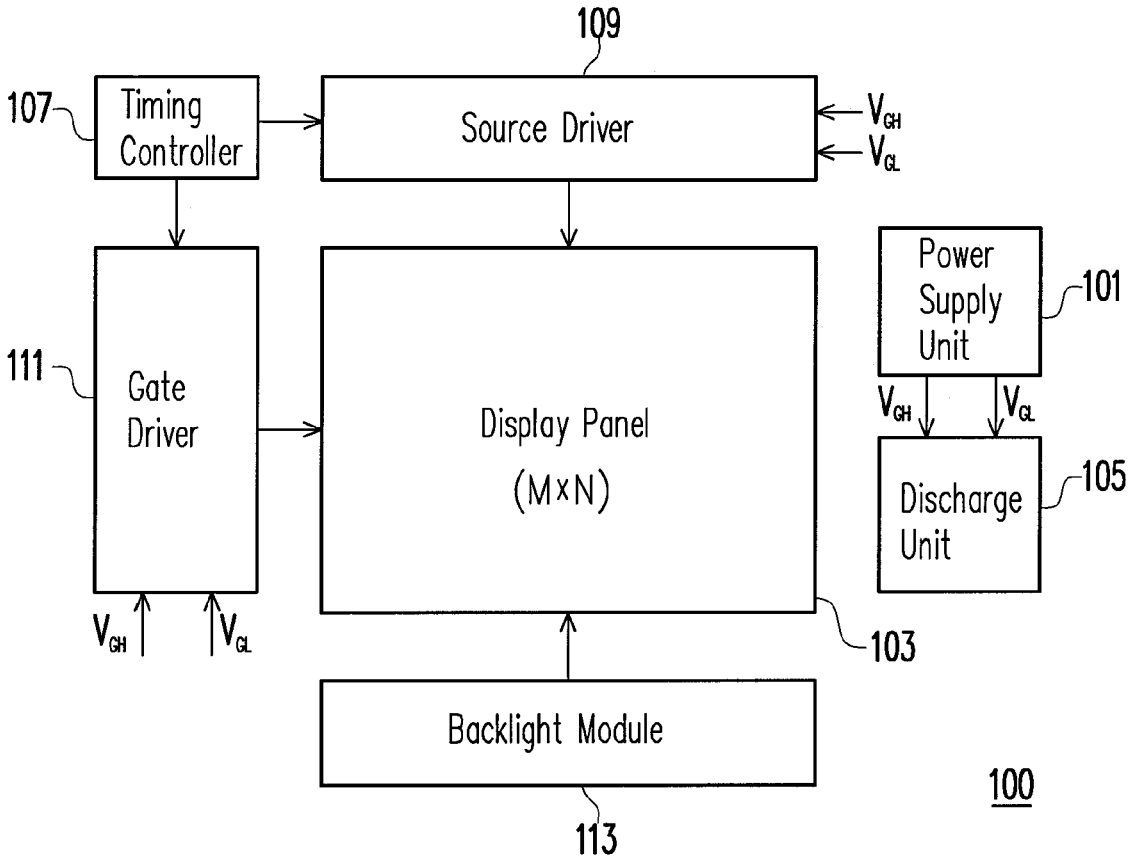
FIG. 1 illustrates a block diagram of a display according to an exemplary embodiment of the present invention.

FIG. 1 illustrates a block diagram of a display 100 according to an exemplary embodiment of the present invention. Referring to FIG. 1, the display 100 may be a thin film transistor liquid crystal display (TFT-LCD) or a low temperature polysilicon thin film transistor liquid crystal display (LTPS TFT-LCD), for instance. The display 100 includes a power supply unit 101, a display panel 103, a discharge unit 105, a timing controller 107, a source driver 109, a gate driver 111, and a backlight module 113.

In the present exemplary embodiment, the power supply unit 101 supplies an electric power to the display 100 when the display 100 is in the power on state, wherein the electric power at least includes a gate on voltage $V_{GH}$ and a gate off voltage $V_{GL}$ supplied to the source driver 109 and the gate driver 111, but the electric power is not limited thereto. The source driver 109 and the gate driver 111 are coupled to the display panel 103 and used for respectively providing the display data and the scan signals to drive the display panel 103.

The timing controller 107 is coupled to the source driver 109 and the gate driver 111. The timing controller 107 is also used for controlling the operation of the source driver 109 and the gate driver 111. The display panel 103 includes a plurality of pixels arranged in an array and represented by M×N as shown in FIG. 1. An image is displayed by the display panel 103 when the display panel 103 is driven by the source driver 109 and the gate driver 111, and while the backlight module 113 provides the backlight source required by the display panel 103.

As disclosed in the related art, since the charges remaining on the electric power supplied by the power supply unit of the LCD can not be discharged timely when the conventional LCD's power is suddenly terminated, so that each of the pixels within the display panel would remain the charges therein, and thus causing the residual image remaining on the display panel for a shorten duration. Accordingly, in the exemplary embodiment, the display 100 uses the discharge unit 105 to improve upon the deficiencies of the related art.

To be specific, the discharge unit 105 is coupled to the power supply unit 101. When the electric power (the gate on voltage $V_{GH}$ and the gate off voltage $V_{GL}$) supplied by the power supply unit 101 is suddenly terminated (the power of the display 100 is suddenly terminated), the electric power supplied by the power supply unit 101 is coupled to a reference voltage Vref (a common voltage or a ground voltage of the display panel 101, for instance, but not limited thereto), so as to accelerately discharge the charges remaining on the electric power supplied by the power supply unit 101, and thereby eliminating the charges remaining on each of the pixels within the display panel 103. Therefore, the residual images do not remain on the display panel 103 when the power of the display 100 is suddenly terminated.

Figure 2A:
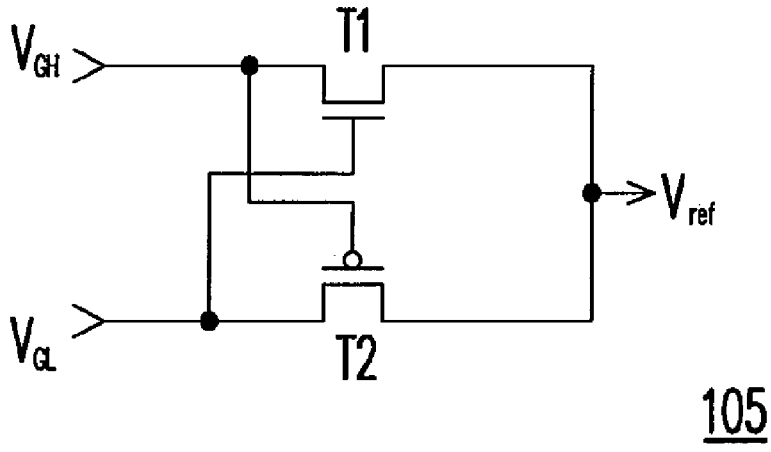
FIG. 2A illustrates a circuit diagram of a discharge unit according to an exemplary embodiment of the present invention.

FIG. 2A illustrates a circuit diagram of the discharge unit 105 according to an exemplary embodiment of the present invention. Referring to both FIG. 1 and FIG. 2A, the discharge unit 105 includes an N-type transistor T1 and a P-type transistor T2. The gate of the N-type transistor T1 receives the gate off voltage $V_{GL}$, the source of the N-type transistor T1 receives the gate on voltage $V_{GH}$, and the drain of the N-type transistor T1 receives the reference voltage Vref (e.g. the common voltage or the ground voltage of the display panel 103, but not limited thereto). The gate of the P-type transistor T2 receives the gate on voltage $V_{GH}$, the source of the P-type transistor T2 receives the gate off voltage $V_{GL}$, and the drain of the P-type transistor T2 receives the reference voltage Vref.

In the exemplary embodiment, when the display 100 is in the power on state, the reference voltage Vref is presumed to be higher than the gate off voltage $V_{GL}$, but the reference voltage Vref is presumed to be lower than the gate on voltage $V_{GH}$. Accordingly, when the gate on voltage $V_{GH}$ is higher than the reference voltage Vref and the gate off voltage $V_{GL}$ is lower than the reference voltage Vref, the discharge unit 105 is not activated because the power supply unit 101 supplies the electric power normally to the display 100 at this time.

In addition, when the gate on voltage $V_{GH}$ is lower than the reference voltage Vref and the gate off voltage $V_{GL}$ is higher than the reference voltage Vref, or when the gate on voltage $V_{GH}$ and the gate off voltage $V_{GL}$ are both higher than the reference voltage Vref, or when the gate on voltage $V_{GH}$ and the gate off voltage $V_{GL}$ are both lower than the reference voltage Vref, the discharge unit 105 is activated because the power supply unit 101 does not supply the electric power normally to the display 100 (i.e. the power of the display 100 is suddenly terminated) at this time, so as to couple the electric power supplied by the power supply unit 101 to the reference voltage Vref.

Consequently, when the power of the display 100 is suddenly terminated, the discharge unit 105 would accelerately discharge the charges remaining on the electric power supplied by the power supply unit 101, and thus eliminating the charges remaining on each of the pixels within the display panel 103 at the same time. Therefore, the residual images do not remain on the display panel 103 when the power of the display 100 is suddenly terminated.

From the above, the discharge unit 105 does not influence the normal operations of the display 100 because the discharge unit 105 is only activated when the power of the display 100 is suddenly terminated.

Figure 2B:
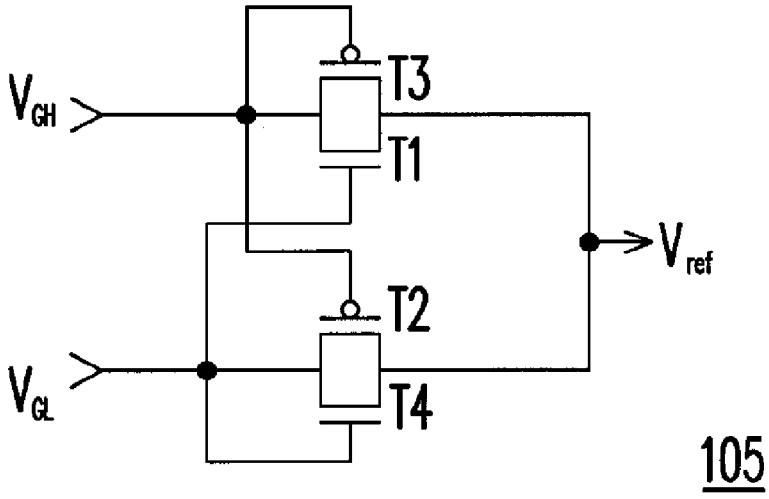
FIG. 2B to FIG. 2D respectively illustrate a circuit diagram of a discharge unit according to another exemplary embodiment of the present invention.

FIG. 2B illustrates a circuit diagram of the discharge unit 105 according to another exemplary embodiment of the present invention. Referring to FIG. 1, FIG. 2A, and FIG. 2B, compared to FIG. 2A, the discharge unit 105 illustrated in FIG. 2B further includes a P-type transistor T3 and an N-type transistor T4. The gate and the source of the P-type transistor T3 receive the gate on voltage $V_{GH}$, and the drain of the P-type transistor T3 receives the reference voltage Vref. The gate and the source of the N-type transistor T4 receive the gate off voltage $V_{GL}$, and the drain of the N-type transistor T4 receives the reference voltage Vref. In the exemplary embodiment, since the operation of the discharge unit 105 illustrated in FIG. 2B is similar to the operation of the discharge unit 105 illustrated in FIG. 2A, no further description is provided herein.

Figure 2C:
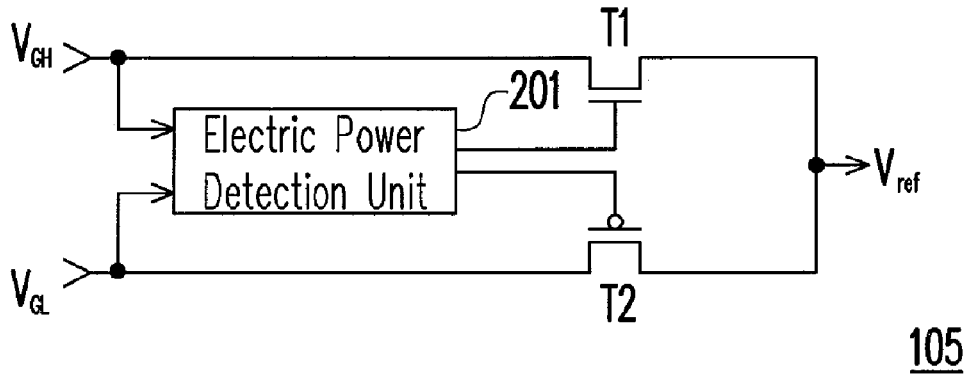

FIG. 2C illustrates a circuit diagram of the discharge unit 105 according to another exemplary embodiment of the present invention. Referring to FIG. 1 and FIG. 2C, the discharge unit 105 includes an N-type transistor T1, a P-type transistor T2, and an electric power detection unit 201. The source of the N-type transistor T1 receives the gate on voltage $V_{GH}$, and the drain of the N-type transistor T1 receives the reference voltage Vref (e.g. the common voltage or the ground voltage of a display panel 103, but not limited thereto). The source of the P-type transistor T2 receives the gate off voltage $V_{GL}$, and the drain of the P-type transistor T2 receives the reference voltage Vref.

In addition, the electric power detection unit 201 is coupled to the gate of the N-type transistor T1 and the gate of the P-type transistor T2 to detect whether the electric power supplied by the power supply unit 101 is terminated or not, and control whether the N-type transistor T1 and the P-type transistor T2 are conducted or not accordingly.

In the exemplary embodiment, when the display 100 is in the power on state, the reference voltage Vref is presumed to be higher than the gate off voltage $V_{GL}$, but the reference voltage Vref is presumed to be lower than the gate on voltage $V_{GH}$. Accordingly, when the electric power detection unit 201 detects that the gate on voltage $V_{GH}$ is higher than the reference voltage Vref and the gate off voltage $V_{GL}$ is lower than the reference voltage Vref, the N-type transistor T1 and the P-type transistor T2 are not conducted by the electric power detection unit 201 because the power supply unit 101 supplies the electric power normally to the display 100 at this time.

In addition, when the electric power detection unit 201 detects that the gate on voltage $V_{GH}$ is lower than the reference voltage Vref and the gate off voltage $V_{GL}$ is higher than the reference voltage Vref, or the gate on voltage $V_{GH}$ and the gate off voltage $V_{GL}$ are both higher than the reference voltage Vref, or the gate on voltage $V_{GH}$ and the gate off voltage $V_{GL}$ are both lower than the reference voltage Vref, the N-type transistor T1 and/or the P-type transistor T2 are conducted by the electric power detection unit 201 because the power supply unit 101 does not supply the electric power normally to the display 100 (i.e. the power of the display 100 is suddenly terminated) at this time, so as to couple the electric power supplied by the power supply unit 101 to the reference voltage Vref.

Consequently, when the power of the display 100 is suddenly terminated, the discharge unit 105 would accelerately discharge the charges remaining on the electric power supplied by the power supply unit 101, and thus eliminating the charges remaining on each of the pixels within the display panel 103 at the same time. Therefore, the residual images do not remain on the display panel 103 when the power of the display 100 is suddenly terminated.

Figure 2D:
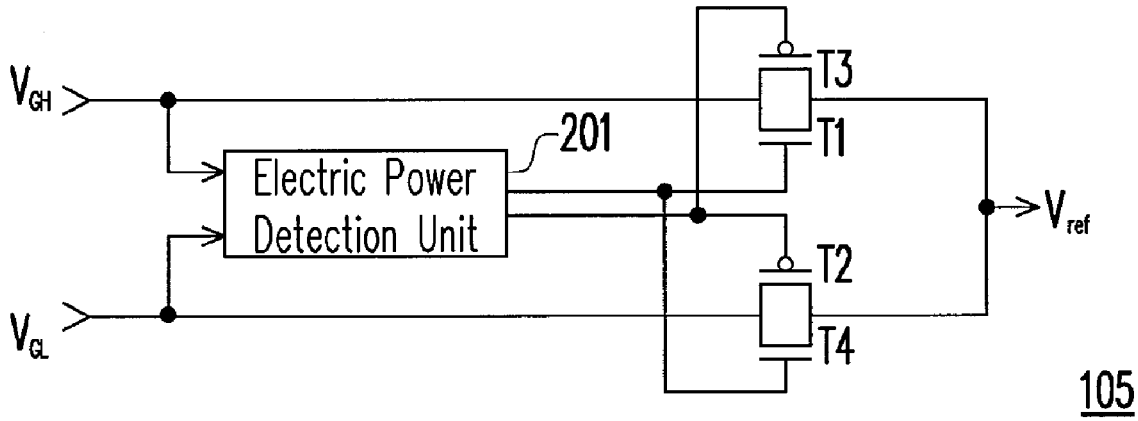

FIG. 2D illustrates a circuit diagram of the discharge unit 105 according to another exemplary embodiment of the present invention. Referring to FIG. 1, FIG. 2C, and FIG. 2D, compared to FIG. 2C, the discharge unit 105 illustrated in FIG. 2D further includes a P-type transistor T3 and an N-type transistor T4. The gate of the P-type transistor T3 is coupled to the electric power detection unit 201, the source of the P-type transistor T3 receives the gate on voltage $V_{GH}$, and the drain of the P-type transistor T3 receives the reference voltage Vref.

The gate of the N-type transistor T4 is coupled to the electric power detection unit 201, the source of the N-type transistor T4 receives the gate off voltage $V_{GL}$, and the drain of the N-type transistor T4 receives the reference voltage Vref. In the exemplary embodiment, the electric power detection unit 201 further detects whether the electric power supplied by the power supply unit 101 is terminated or not, and control whether the N-type transistors T1 and T4, and the P-type transistors P2 and P3 are conducted or not accordingly.

However, since the operation of the discharge unit 105 illustrated in FIG. 2D is similar to the operation of the discharge unit 105 illustrated in FIG. 2C, no further description is provided herein.

In view of the foregoing descriptions of the previous exemplary embodiments, the discharge unit 105 can be independently existed in the system of the display 100. However, in the other exemplary embodiments of the present invention, the discharge unit 105 can be integrated with the display panel 103, the timing controller 107, the source driver 109, or the gate driver 111. These varied embodiments are still within the scope of the present invention for which protection is sought.

Figure 3:
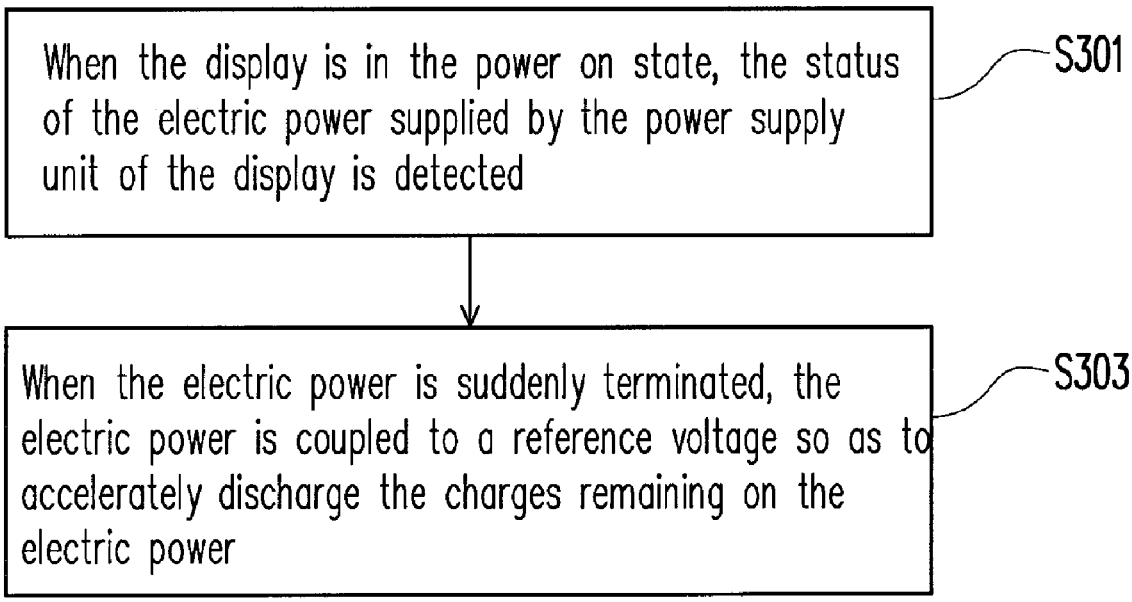
FIG. 3 illustrates a flowchart of a method for eliminating a residual image on a display according to an exemplary embodiment of the present invention.

Furthermore, FIG. 3 illustrates a flowchart of a method for eliminating a residual image on a display according to an exemplary embodiment of the present invention. Referring to FIG. 3, in the exemplary embodiment, the method includes detecting the status of an electric power supplied by the power supply unit of the display when the display is in the power on state (Step S301), wherein the electric power at least includes the gate on voltage and the gate off voltage; and coupling the electric power to a reference voltage (the common voltage or the ground voltage of a display panel of the display, for instance) when the electric power is suddenly terminated, so as to accelerately discharge the charges remaining on the electric power (Step S303). Accordingly, the charges remaining on each of the pixels within the display panel also could be eliminated at the same time, and thus the residual images do not remain on the display panel when the power of the display is suddenly terminated.

In summary, in the present invention, a discharge unit is added into the display. When the power of the display is suddenly terminated, the discharge unit accelerately discharge the charges remaining on the electric power, and thereby eliminating the charges remaining on each of the pixels within the display panel at the same time. Therefore, the residual images do not remain on the display panel when the power of the display is suddenly terminated, and thus resolving the disadvantages mentioned from the related art.

Although the present invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A display comprising:

a power supply unit, for supplying an electric power to the display when the display is in power on state, wherein the electric power at least comprises a gate on voltage and a gate off voltage;

a display panel having a plurality of pixels arranged in a matrix, for displaying an image; and a discharge unit coupled to the power supply unit, for coupling the gate on voltage and the gate off voltage to a reference voltage when the electric power is suddenly terminated, so as to accelerately discharge charges remaining on the gate on voltage and the gate off voltage and thereby eliminating charges remaining on the pixels, wherein the discharge unit comprises:

a first transistor, having a gate receiving the gate off voltage, a source receiving the gate on voltage, and a drain receiving the reference voltage; and a second transistor, having a gate receiving the gate on voltage, a source receiving the gate off voltage, and a drain receiving the reference voltage.

2. The display as claimed in claim 1, wherein the discharge unit further comprises:

a third transistor, having a gate and a source both receiving the gate on voltage, and a drain receiving the reference voltage; and a fourth transistor, having a gate and a source both receiving the gate off voltage, and a drain receiving the reference voltage.

3. The display as claimed in claim 2, wherein the first transistor and the fourth transistor are N-type transistors, and the second transistor and the third transistor are P-type transistors.

4. The display as claimed in claim 1, wherein the gate of the first transistor is changed to be decoupled with the gate off voltage, the gate of the second transistor is changed to be decoupled with gate on voltage, and the discharge unit further comprises:

an electric power detection unit coupled to the gates of the first transistor and the second transistor, for detecting whether the electric power is terminated or not, and controlling whether the first transistor and the second transistor are conducted or not accordingly.

5. The display as claimed in claim 4, wherein the discharge unit further comprises:

a third transistor, having a source receiving the gate on voltage, and a drain receiving the reference voltage; and a fourth transistor, having a source receiving the gate off voltage, and a drain receiving the reference voltage.

6. The display as claimed in claim 5, wherein the electric power detection unit is further coupled to gates of the third and the fourth transistors, and further controlling the third and the fourth transistors are conducted or not by detecting whether the electric power is terminated or not.

7. The display as claimed in claim 5, wherein the first transistor and the fourth transistor are N-type transistors, and the second transistor and the third transistor are P-type transistors.

8. The display as claimed in claim 1, wherein the discharge unit and the display panel are integrated together.

9. The display as claimed in claim 1, further comprising:

a gate driver coupled to the display panel, for driving the display panel;

a source driver coupled to the display panel, for driving the display panel;

a timing controller coupled to the gate driver and the source driver, for controlling the operations of the gate driver and the source driver; and a backlight module, for providing a backlight source required by the display panel.

10. The display as claimed in claim 9, wherein the discharge unit is integrated with the gate driver or the source driver.

11. The display as claimed in claim 9, wherein the discharge unit and the timing controller are integrated together.

12. The display as claimed in claim 9, wherein the display is a liquid crystal display.

13. The display as claimed in claim 12, wherein the liquid crystal display comprises a thin film transistor liquid crystal display or a low temperature polysilicon thin film transistor liquid crystal display.

14. The display as claimed in claim 1, wherein the reference voltage is a common voltage or a ground voltage of the display panel.

* * * * *